US005368759A

United States Patent [19]

Horodysky et al.

[11] Patent Number: 5,368,759

[45] Date of Patent: Nov. 29, 1994

[54] ESTER FLUIDS WITH HIGH TEMPERATURE STABILITY

[75] Inventors: Andrew G. Horodysky, Cherry Hill; Liwen Wei, Belle Mead; Ross A. Kremer, Ringoes, all of N.J.

[73] Assignee: Mobil Oil Corporation, Fairfax, Va.

[21] Appl. No.: 69,483

[22] Filed: Jun. 1, 1993

Related U.S. Application Data

[63] Continuation-in-part of Ser. No. 992,671, Dec. 18, 1992.

[51] Int. Cl.[5] ..... C10M 135/00

[52] U.S. Cl. ..... 252/475; 252/48.2; 252/48.4

[58] Field of Search ..... 252/47.5, 48.2, 48.4; 554/101; 560/152, 173, 187, 38

[56] References Cited

U.S. PATENT DOCUMENTS

| | | | |
|---|---|---|---|
| 4,181,617 | 1/1980 | Elrod et al. | 554/101 |
| 4,211,663 | 7/1980 | Braid | 252/42.7 |
| 4,305,832 | 12/1981 | Braid | 252/48.2 |
| 4,393,241 | 7/1983 | Hanson et al. | 568/49 |
| 4,440,655 | 4/1984 | Gemmill et al. | 252/42.5 |
| 4,460,486 | 7/1984 | Newkirk | 252/59 |
| 4,906,390 | 3/1990 | Horodysky | 252/46.3 |

OTHER PUBLICATIONS

March, Advanced Organic Chemistry, pp. 346–347 (1985) (no month).

*Primary Examiner*—John Niebling
*Assistant Examiner*—Edna Wong
*Attorney, Agent, or Firm*—Alexander J. McKillop; Malcolm D. Keen; Jessica M. Sinnott

[57] ABSTRACT

An ester-containing reaction product of a carbonyl compound, preferably an acyl halide and a thiodiphenol has high temperature antioxidant properties. The reaction product is useful as a synthetic lubricant base fluid or as an antioxidant additive when used in minor amounts of 0.01 to 10 wt. % in a mineral oil or hydrocracked oil lubricant base fluid. The reaction product can also be used in a fuel.

12 Claims, No Drawings

ESTER FLUIDS WITH HIGH TEMPERATURE STABILITY

CROSS REFERENCE TO RELATED APPLICATIONS

This application is a continuation-in-part of Ser. No. 07/992,671, filed on Dec. 18, 1992, which is incorporated herein by reference in its entirety.

FIELD OF THE INVENTION

The invention relates to esters of sulfur-containing mono or polyhydroxy-derived aromatics which exhibit high temperature oxidative stability and antiwear characteristics. They can be used as a lubricant basestock, a blending stock, or as an additive in a lubricant basestock.

BACKGROUND OF THE INVENTION

Oxidation of a lubricating fluid can occur during ordinary, as well as severe, conditions of use. Oxidation causes the properties and the chemical structure of the fluid to change dramatically, leading to bearing corrosion, piston ring sticking, lacquer and sludge formation and excessive fluid viscosity. Current commercial synthetic lubricant base fluids are not suitable for very high temperature engine operation, they tend to degrade under rigorous thermal/oxidative conditions. Because of this, they have an operating ceiling of about 200° to 250° C., in the presence of antioxidants. While future engine temperatures increase to boost engine operating efficiency, new classes of base fluids need to be developed. Fluids such as polyphenyl ethers or perfluoro hydrocarbon fluids are useful at high temperatures; they are expensive and their lubricating properties are limited, particularly at low temperatures, having a pour point range of about 10°–15° C. which is not suitable for most lubricant uses. The common practice of the art utilizes an antioxidant to reduce the rate of oxidation of the lubricating oil and thereby improve the apparent thermal/oxidative stability.

Direct frictional contact between relatively moving surfaces even in the presence of a lubricant can cause wear of the surfaces. The elimination of wear is an ideal goal which is approached by blending the lubricating media with additives which can reduce the wear. The most suitable antiwear additives are those that help to create and maintain a persistent film of lubricant even under severe conditions such as high temperatures which thin the lubricant film and extreme pressures which squeeze the lubricant film away from the contacting surfaces. Wear is most serious in internal combustion engines, diesel engines and gasoline engines in which metal parts are exposed to sliding, rolling and other types of forceful, frictional mechanical contact. Specific areas of wear occur in the gears, particularly hypoid gears which are under high loads, piston rings and cylinders and bearings such as ball, sleeve and roller bearings.

Sulfur-containing derivatives, such as 4,4-thiodiphenol, are known to provide beneficial additive properties such as antioxidancy, antiwear and an ability to lubricate under extreme pressure conditions in lubricant applications. A concern, however, is that they are known to degrade upon exposure to high temperatures, i.e., over about 150° C., during engine operation leading to engine corrosion and deposit formation.

Thiophenol-derived reaction products have been considered to solve these problems. For example, transition/alkali metal complexes of thiobis(alkylphenols) are described in U.S. Pat. No. 4,211,663 for their antioxidant performance in lubricating oils. However, for environmental and economic reasons it is desirable to avoid the use of metals in lubricant additives.

Thus, various non-metal derivatives have been developed. Borated diol-phenol sulfides are described in U.S. Pat. No. 4,906,390 for their friction and corrosion reducing properties in lubricants. U.S. Pat. No. 4,440,655 describes lubricant additives made by using a thiodiphenol in a Mannich reaction. U.S. Pat. No. 4,460,486 describes a polyoxyalkylene compound derived from 4,4'-thiodiphenol as useful as fiber and rubber lubricant additives having antioxidant properties. Derivatives of phenolic thioacetals as lubricant additives having antioxidant properties are described in U.S. Pat. No. 4,305,832.

A nucleophilic substitution reaction between alcohols and acylhalides to produce esters is known as described in March *Advanced Organic Chemistry,* pp. 346–347 (1985).

BRIEF SUMMARY OF THE INVENTION

This invention is more particularly directed to alkyl esters of sulfur-containing mono or poly hydroxy-derived aromatics which exhibit excellent high temperature antioxidant properties. They can be used as an additive or a lubricant basestock, and can be used in engine oils, marine lubricants, aviation, industrial gear, compressor, way, hydraulic, diesel automotive and other lubricant applications. Antiwear and extreme pressure resistant properties, additional antifatigue, detergents, dispersants, corrosion inhibitors, antistaining, emulsive/demulsive, antifoaming, friction reducing and additive solubilizing properties are likely.

The reaction product is made by reacting a phenol sulfide with an aliphatic carboxylic group generating species. The reaction product has the following general structural formula:

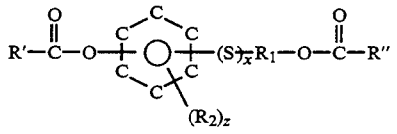

where R' and R'' are the same or different hydrocarbon groups containing from 1 to 30 carbon atoms or from 2 to 30 carbon atoms and at least one heteroatom selected from the group consisting of sulfur, nitrogen and oxygen, $R_1$ is a hydrocarbon group or mixture containing from 1 to 30 carbon atoms or an aromatic group containing from 6 to 30 carbon atoms, $R_2$ is a hydrocarbon group containing 1 to 30 carbon atoms or a halogen group, x is an integer ranging from 1 to 3, preferably 1, and z is an integer ranging from 0 to 4 and preferably 0 to 2.

An important feature of the reaction product is that their structural backbone lacks the benzylic hydrogens, therefore preventing thermal/oxidative degradation which renders the compound inherently stable.

Thus, the invention is directed to a lubricative composition having antioxidant properties comprising the reaction product of a carbonyl-containing aliphatic hydrocarbon and a phenol sulfide of the structural formula

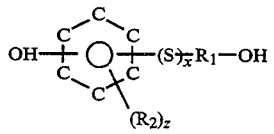

combined in a mole ratio ranging from about 1 to 2 under esterification conditions to produce a reaction product having the structural formula:

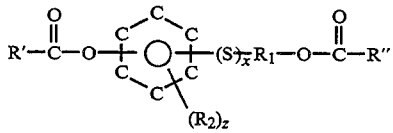

where R′ and R″ are the same or different :hydrocarbon groups containing from 1 to 30 carbon atoms or from 2 to 30 carbon atoms and at least 1 heteroatom selected from the group consisting of sulfur, nitrogen and oxygen, $R_1$ is a hydrocarbon group or mixture containing from 1 to 30 carbon atoms or an aromatic group containing from 6 to 30 carbon atoms, $R_2$ is a hydrocarbon group containing from about 1 to about 30 carbon atoms or a halogen group, x is an integer ranging from 1 to 3, preferably 1, and z is an integer ranging from 0 to 4 and preferably 0 to 2.

DETAILED DESCRIPTION OF THE INVENTION

The reaction product of the invention is derived by reacting a phenolsulfide with an aliphatic carboxylic group generating species such as carboxylic acid, anhydrides or acid halides.

The phenol sulfide is characterized by the presence of at least one phenol group and at least one sulfur atom. The aromatic of the phenol is considered necessary for purposes of stability and resistance to oxidative degradation while the sulfur atom is considered necessary for high temperature antioxidant and antiwear properties. The phenol sulfide is represented by the following structural formula:

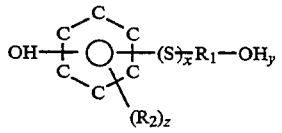

where $R_1$ is a hydrocarbon group or mixture thereof containing from 1 to 30 carbon atoms, or an aromatic group containing from 6 to 30 carbon atoms, $R_2$ is a hydrocarbon group containing 1 to 30 carbon atoms or a halogen group, i.e. F, Cl, Br or I; x is an integer ranging from 1 to 3, and z is an integer ranging from 0 to 4, preferably 1.

When $R_1$ is an alkyl group it can be a linear or branched hydrocarbon such as propyl, butyl, isobutyl or 2-ethylhexyl. Preferably, however, $R_1$ is phenyl or naphthyl which can contain from 0 to 4, preferably from 0 to 2, substituent groups represented by $R_3$. $R_3$ falls within the definition of $R_2$; that is, $R_3$ can be a hydrocarbon group containing from 1 to 30 carbon atoms or a halogen group such as F, Cl, Br, or I. Where it is desirable for the compound to have flame retardent properties, since these compounds can be exposed to high temperatures, at least one group represented by $R_3$ is Br, and this can apply to $R_2$ as well.

The preferred phenols are the thiodiphenols in which $R_1$ is an aromatic group and x=1. Representative examples of suitable thiodiphenols include 4,4-thiodiphenol, structural isomers thereof and commercial mixtures of isomers and oligomers of thiodiphenol.

In general, the thiodiphenols are sulfurized phenols which can be made by any method known to the art. In one method the phenol is initially reacted with a sulfur halide, such as sulfur monochloride or dichloride in a 1:1 to 3:1, preferably 3:2, mole ratio. The resulting phenol sulfide may be further reacted with other phenols and sulfur halides to produce a thiophenol oligomer.

To make the reaction product ester of the invention, the phenol sulfide is reacted with a carboxylic group generating species, a carboxylic acid, or anhydride, or acid halide represented by the structural formula:

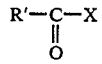

Where R′ is a hydrocarbon group containing from 1 to 30 carbon atoms, preferably from 1 to 30 carbon atoms and X is a halogen group, OH, or acyl generating species. A halogen is exemplified by F, Cl, Br and I, preferably X is Cl. R′ can be a straight chain or branched hydrocarbon group. Although for good viscometric properties, R′ is preferably a linear hydrocarbon group, for added oxidative stability some degree of branching is needed. Thus, to satisfy these competing properties, a mixture of linear and branched hydrocarbon groups can be used. Representative examples of appropriate acyl halides include 2-ethylhexanolyl chloride, butyl chloride, pivalic chloride, hexyl chloride, octyl chloride or decyl chloride.

For even greater stability and where good viscometrics are not an overriding property, the reactants can be selected so that the ultimate reaction product is a neoacid; that is, the beta carbon of the carboxylic acid group is connected directly to four other carbon atoms. In this case, the preferred acyl halide is neodecanoyl chloride.

Any synthesis route known in the art can be used to produce the reaction products of the invention. Typically, the acyl halide is added to the phenol sulfide in the presence of a suitable catalyst. When the acyl halide is used a base it is usually added to combine with the halogen. Representative examples of suitable bases include KOH, NaOH, $K_2CO_3$ or aliphatic amines.

Typically, a phase transfer catalyst can be used to facilitate the reaction. Representative examples include quaternary ammonium compounds, or crown ethers, polyglycols, preferably quaternary amine compounds. The quaternary ammonium compound is represented by the structural formula: $R_4R_5R_6R_7N^+An^-$, where $R_4$, $R_5$, $R_6$ and $R_7$ are the same or different hydrocarbon containing 1 to 20 carbon atoms and An is an anion such as a halogen, i.e. fluorine, chlorine, bromine or iodine, sulfate, nitrate or other common anion. Specific examples of quaternary ammonium compounds are tetrabutylammonium bromide, tetraethylammonium chloride, tetrapentylammonium chloride and dialkly $C_{12}$–$C_{13}$ dimethyl ammonium chloride.

The reactants are combined in mole ratios ranging from about 0.5–1:1 of acyl halide to phenolsulfide, preferably in a mole ratio of about 0.75–1:1.

The reactants are contacted for a period of about 1 hour to 30 hours, preferably from about 2 hours to 10 hours while continuously stirring the reaction mixture at a reduced temperature and in an inert atmosphere, such as under a nitrogen blanket. The temperature of reaction is maintained in a range of about 20° C. to 150° C., preferably from about 30° C. to 120° C. When reaction is complete as indicated by gas chromatography, the reaction mixture is washed with water to facilitate separation of the undesirable materials from the product, such as the catalytic residues. The aqueous wash solution is then separated from the hydrophobic product. The light ends are removed by distillation at 160° C. under a reduced pressure atmosphere of about 1 to 10 mmHg.

The reaction products of the instant invention can be utilized as lubricative basestock materials and in this regard, they can be used in an amount ranging from 50 to 100%, preferably 80 to 99% with additional additive materials consitituting the remaining amount of the total lubricant composition.

They can also be used as a partial fluid replacement in admixture with other fluids at a concentration of from about 5–50%.

Alternatively, the reaction products of the invention can be used as an antioxidant or antiwear additive in a non-aqueous lubricant or grease in an amount preferably from about 0.01 to 5 wt. % or more preferably from 0.5–3%. The kinds of lubricants likely to benefit from the additive of the instant invention include liquid oils in the form of either a mineral oil, hydrocracked oil, synthetic oil or mixtures thereof. In general, the oils include both paraffinic and naphthenic components. The lubricating oils are of a suitable lubrication viscosity range to comply with engine oil specifications, for example, as set by the SAE, e.g. single grade oils such as 30, 40, 50, 5W, 10W grade or multigrade oils such as 0W-30, 5W-30, 10W-40, 10W-50, etc. Base oil viscosities may typically range, for example, from about 45 SSU at 100° F. to about 6000 SSU at 100° F., and preferably from about 50 to 250 SSU at 210° F. Viscosity indexes from about 95 to 130, and even higher, being preferred.

Where synthetic oils, or synthetic oils employed as a vehicle for a grease are desired in preference to mineral oils, or in mixtures of mineral and synthetic oils, various synthetic oils may be used. Typical synthetic oils include polyisobutylenes, polybutenes, polydecenes and other polyalpha olefin lubricating fluids used in engine oils.

The fluid can be used as an additive in greases, or as the vehicle for greases.

Where the reaction product is utilized as an additive, or as the lubricative base fluid, the lubricating oil compositions can contain other additives generally employed such as corrosion inhibitors, detergents, co-extreme pressure agents, viscosity index improvers, friction reducers, co-antiwear agents, co-antioxidants and the like.

It is expected that the reaction products of the invention would contribute their antioxidant and antiwear properties to a fuel. In this case, the reaction product will be blended with a fuel in amounts ranging from about 1 to 1000 lbs of additive/1000 Bbl of fuel, preferably from about 5 to 250 lbs of additive/1000 Bbl of fuel. The fuels contemplated include gasoline and diesel fuels. Specifically, petroleum distillate fuels having an initial boiling point above 75° F. to about 135° F. and an end boiling point from about 250° F. to about 750° F. Gasoline base stocks such as a mixture of hydrocarbons boiling in the gasoline boiling range which is from about 90° F. to about 350° F. are particularly included. This base fuel may consist of straight chain, branched chain or cyclic hydrocarbons: paraffins, cycloparaffins, olefins, aromatic hydrocarbons, or mixtures thereof. The base fuel can be derived from sources such as, straight run naphtha, alkylate, or from catalytically cracked or thermally cracked gasoline or reformate. The composition and octane level of the base fuel are not critical and any conventional motor fuel base can be employed in the practice of this invention.

Other fuel compositions contemplated include distillate fuels and this is not intended to be restricted to straight-run distillate fractions. These distillate fuels can be straight-run distillate fuels, catalytically or thermally cracked, or hydrocracked distillate fuels, or other distillate components. The distillate fuels specifically contemplated are road diesel fuels. These diesel fuels boil in the range from about 330° F. to about 750° with the end point ranging from about 440° F. to about 650°, usually the end boiling point is not more than about 700° F.

The fuels can be treated in accordance with well-known commercial methods, such as mercaptan extraction or oxidation, hydrofinishing, etc.

The fuels may include oxygenate components such as alcohols and/or ethers, for example, hydrocarbon fuels which contain oxygenates in amounts of up to about 50% volumes per volume. Typical examples of such oxygenated fuel components are methanol, ethanol and mixtures of methanol and ethanol, diisopropylether (DIPE), isopropanol (IPA), methyl-tert-butyl ether (MTBE) or tert-amyl-methyl ether (TAME).

The fuel compositions of the instant invention may additionally comprise concentrations of additives which are generally employed in fuel compositions. Thus, fuel compositions made in accordance with the instant invention may additionally contain conventional carburetor detergents, anti-icing additives, co-antiwear additives and co-antioxidants.

EXAMPLE 1

2-Ethylhexanoyl chloride (326 gram) was added dropwise in four hours to an aqueous mixture containing 4,4' thiodiphenol (or bisphenol sulfide) (218 gram), KOH (150 g, 85%), tetrabutylammonium bromide (10 gram), and water (150g) at 30° C. under nitrogen and an ice bath with stirring. After this, the mixture was stirred at ambient temperature overnight. The resulting mixture was then added to 200 grams of water, and the aqueous phase was separated from the liquid product. The product was washed three times with 100 ml water. The light ends were removed by distillation at 160° C. under reduced pressure. The product was filtered through alumina (neutral) to give a clear and colorless liquid product (390 g, 83% yield). The product was found to have the following properties: KV @100° C. of 7.8 cst, KV @ 40° C. of 68.5 cst and pour point of −37° C.

EVALUATION OF THE INVENTION

The unadditized product of Example 1 was evaluated by Differential Scanning Calorimetry at 500 psi oxygen, 80° C. 5°/min/350° C. The induction temperature was recorded at the temperature when the base oil began to decay. The products were found to have 20° to 70° C. higher induction temperatures than commercial synthetic hydrocarbon fluids as shown in Table 1. This indicates that the reaction products are useful at higher operating temperatures.

TABLE 1

Differential Scanning Calorimetry Test Results

| Base Fluid | Induction Temperature (°C.) |
|---|---|
| Example 1 | 248 |
| Alkylated Aromatic | 224 |
| Trimethylolpropane-derived polyol esters | 197 |
| Pentaerythritol derived polyol esters | 194 |
| Polyalphaolefins | 178 |

The unadditized reaction product was tested for its ability to resist oxidative degradation in a catalytic oxidation test. The Catalytic Oxidation Test was conducted at 325° F. for 40 hours (Table 2). A comparison of the oxidation-inhibiting characteristics of the products of the present invention with other commercial fluids was included in Table 2.

The Catalytic Oxidation test procedure consisted of subjecting a volume of the test lubricant to a stream of air which was bubbled through the test composition at a rate of about 5 liters per hour for the specified number of hours and at the specified temperature. Present in the test composition were metals frequently found in engines, namely:

1) 15.5 square inches of a sand-blasted iron wire;

2) 0.78 square inches of a polished copper wire;

3) 0.87 square inches of a polished aluminum wire; and 4) 0.107 square inches of a polished lead surface.

The results of the test were presented in terms of the percent change in kinematic viscosity at 100° C. (% KV). Essentially, the small change in KV meant that the lubricant resisted oxidative degradation under high temperatures.

The results of the Catalytic Oxidation test are reported in Table 2.

TABLE 2

Catalytic Oxidation Test (325° F., 40 hr)

| Base Fluid | % KV @ 100° C. |
|---|---|
| Example 1 | 0.7 |
| Alkylated Aromatics | 15.0 |
| Trimethylolpropane-derived polyol esters | 21.0 |
| Pentaerythritol-derived esters | 120.0 |
| Polyalphaolefins | 230.0 |

What is claimed is:

1. A method of making a lubricative composition having antioxidant properties comprising reacting an acyl halide and a phenol sulfide of the structural formula:

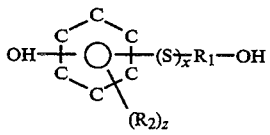

in a mole ratio ranging from about 1 to 2 under esterification conditions to produce a reaction product having the structural formula:

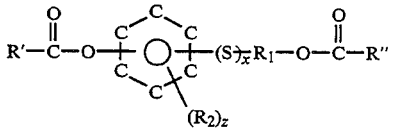

where R′ and R″ are the same or different hydrocarbon groups containing from about 1 to 30 carbon atoms or from about 2 to 30 carbon atoms and optionally containing at least one heteroatom selected from the group consisting of sulfur, nitrogen and oxygen, $R_1$ is a hydrocarbon group containing from about 1 to about 30 carbon atoms or an aromatic group containing from about to about 30 carbon atoms, $R_2$ is a hydrocarbon group containing about 1 to about 30 carbon atoms or a halogen group, x is an integer ranging from 1 to 3, and z is an integer ranging from 1 to 4.

2. The method of claim 1 in which the acyl halide is 2-ethylhexanoyl halide.

3. The method of claim 2 in which the acyl halide is 2-ethylhexanoyl bromide.

4. The method of claim 1 in which the acyl halide and the phenol sulfide are combined in the presence of a quaternary ammonium compound.

5. The method of claim 4 in which the quaternary ammonium compound is tetrabutylammonium bromide.

6. The method of claim 1 in which the phenol sulfide is thiodiphenol.

7. The method of claim 1 in which $R_1$ is phenyl.

8. The method of claim 7 in which R′ and R″ are each ethylhexyl.

9. A method of lubricating which inhibits lubricant oxidation comprising providing a non-aqueous oil composition having antioxidant properties between relatively moving metal surfaces, the non-aqueous lubricant oil composition comprising a major proportion of a liquid lubricant oil or a grease made therefrom and about 0.01 to 5 wt. % of a reaction product having the structural formula:

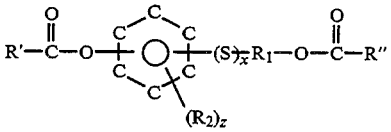

where R′ and R″ are the same or different hydrocarbon groups containing from about 1 to 30 carbon atoms or from about 2 to 30 carbon atoms and optionally containing at least one heteroatom selected from the group consisting of sulfur, nitrogen and oxygen, $R_1$ is a hydrocarbon group containing from about 1 to about 30 carbon atoms or an aromatic group containing from about to about 30 carbon atoms, $R_2$ is a hydrocarbon group containing from about 1 to about 30 carbon atoms or a halogen group, x is an integer ranging from 1 to 3, and z is an integer ranging from 1 to 4.

10. The method of claim 9 in which the liquid lubricant oil is selected from the group consisting of a mineral oil or hydrocracked oil or mixture thereof.

11. The method of claim 9 in which $R_1$ is phenyl.

12. The method of claim 11 in which R′ and R″ are each ethylhexyl.

* * * * *

UNITED STATES PATENT AND TRADEMARK OFFICE

CERTIFICATE OF CORRECTION

PATENT NO. : 5,368,759
DATED : November 29, 1994
INVENTOR(S) : A. G. Horodysky et al.

It is certified that error appears in the above-indentified patent and that said Letters Patent is hereby corrected as shown below:

Col. 8, lines 17-18, after "about" and before "to" insert --6--.

Col. 8, lines 57-58, after "about" and before "to" insert --6--.

Signed and Sealed this

Sixteenth Day of May, 1995

*Attest:*

*Attesting Officer*

BRUCE LEHMAN

*Commissioner of Patents and Trademarks*